US007950624B2

(12) United States Patent
Liao

(10) Patent No.: US 7,950,624 B2
(45) Date of Patent: May 31, 2011

(54) WATER VALVE APPARATUS

(76) Inventor: Hui-Fen Liao, Zhonghe (TW)

( * ) Notice: Subject to any disclaimer, the term of this patent is extended or adjusted under 35 U.S.C. 154(b) by 497 days.

(21) Appl. No.: 12/204,106

(22) Filed: Sep. 4, 2008

(65) Prior Publication Data

US 2010/0051845 A1 Mar. 4, 2010

(51) Int. Cl.
*F16K 31/00* (2006.01)

(52) U.S. Cl. ..... 251/251; 251/339; 222/509; 239/583

(58) Field of Classification Search ..... 251/339, 251/229, 230, 319, 251, 259; 137/801; 4/678; 222/509; 119/72; 239/583
See application file for complete search history.

(56) References Cited

U.S. PATENT DOCUMENTS

| | | | | |
|---|---|---|---|---|
| 4,456,222 | A | 6/1984 | Shen | |
| 4,512,551 | A | 4/1985 | Dalferth | |
| 4,771,985 | A | 9/1988 | Gross et al. | |
| 4,940,206 | A * | 7/1990 | Chung-Shan | 251/52 |
| 5,065,700 | A * | 11/1991 | Cross | 119/72.5 |
| 5,131,622 | A | 7/1992 | Chang | |
| 5,203,376 | A * | 4/1993 | Chung-Shan | 137/801 |
| 5,286,000 | A | 2/1994 | Katz | |
| 5,456,448 | A * | 10/1995 | Chou | 251/230 |
| 5,651,531 | A | 7/1997 | Lu | |
| 5,704,397 | A | 1/1998 | Lu | |
| 6,131,608 | A | 10/2000 | Lu | |
| 6,739,572 | B2 * | 5/2004 | Shen et al. | 251/52 |
| 6,942,195 | B2 | 9/2005 | Kao | |
| 7,143,997 | B2 * | 12/2006 | Kao | 251/339 |

FOREIGN PATENT DOCUMENTS

| | | |
|---|---|---|
| TW | 575121 | 2/2004 |
| TW | I228578 | 3/2005 |
| TW | I271484 | 1/2007 |

* cited by examiner

*Primary Examiner* — John Bastianelli
(74) *Attorney, Agent, or Firm* — Frenkel & Associates

(57) ABSTRACT

A water valve apparatus includes a housing and a control valve stem. The housing has a spacer to divide the interior space and a base with a plurality of water outlets formed thereon. The spacer has a first opening. The base has a second opening corresponding to the first opening. The spacer and base are interposed by a displacement track. The displacement track has at least one first anchor zone and one second anchor zone. The valve control stem runs through the first opening and second opening, and has a water stopper located in the first opening and an anchor ring movably coupled thereon. The anchor ring has at least an anchor stub in the displacement track. The valve control stem is operable easily to allow users to determine water supply. No excessive contact with water faucets is needed. Thus the risk of bacteria contagion can be minimized.

11 Claims, 10 Drawing Sheets

WATER VALVE APPARATUS

FIELD OF THE INVENTION

The present invention relates to a water valve apparatus and particularly to water valve apparatus to provide simple control of water supply.

BACKGROUND OF THE INVENTION

The commonly seen water control apparatus now on the market mainly are mechanical water faucets. When in use they are opened and closed by turning to regulate water flow. When the turning angle or force is insufficient water flow cannot be completely stopped. Waste of water resource occurs.

There is another conventional method to control water flow through infrared ray detection. By placing user's hands in an infrared ray detection area the faucet can be triggered to open or close. But the infrared ray sensor is expensive and easily malfunctions. It is not always economically justified.

There are many other water valve control devices known in the art, such as U.S. Pat. Nos. 4,512,551 and 5,286,000. They mainly have an operating lever in the spout of a water faucet. The operating lever has a sealing structure to seal the water outlet. By changing the angle of the operating lever water can flow out. However, to stop water flow could be difficult sometimes due to not proper positioning of the angle of the operating lever and result in waste of water resource. Other water valve apparatus references are available in R.O.C. patent No. 575121 and U.S. Pat. Nos. 5,131,622, 5,704,397 and 6,131,608. They mostly have a spring in the water valve to strengthen the sealing structure to stop water outflow. But the spring could suffer from elastic fatigue and fail to maintain a desired sealing condition.

R.O.C. patent Nos. I228578 and I271484, and U.S. Pat. Nos. 4,456,222, 4,771,985, 5,651,531 and 6,942,195 disclose many types of water valves without springs. They mostly have a regulation lever and a corresponding ratchet gear structure. Through water pressure and user's applied force the regulation lever can be anchored on different positions to determine water outflow. However, their structures are complicated and difficult to produce and assemble, thus lack desired stability.

SUMMARY OF THE INVENTION

The primary object of the present invention is to simplify the entire structure of a water valve and increase its life span. To achieve the foregoing object the water valve apparatus according to the invention includes a housing and a control valve stem. The housing has a spacer to divide the interior space thereof into a first chamber and a second chamber, and a base located at the bottom of the housing with a plurality of water outlets formed thereon. The spacer has a first opening communicating with the first chamber and the second chamber. The base has a second opening corresponding to the first opening. The spacer and the base have respectively a first track portion and a second track portion opposing each other. There is a displacement track between the first track portion and the second track portion. The displacement track has at least a first anchor zone and a second anchor zone. The control valve stem runs through the first opening and second opening, and has a water stopper located in the first opening to stop communication of the first chamber and second chamber, and an anchor ring movably coupled on the control valve stem. The anchor ring has at least one anchor stub in the displacement track. Through the anchor stub anchor ring can move to the first anchor zone or second anchor zone to drive the control valve stem at a water supply position with the first and second chambers communicating with each other, or a water stop position with the first and second chambers not communicating with each other.

The water stopper has a bulged portion to withstand water pressure and closely seal the first opening to stop water from passing through. To provide filtering effect for the water valve apparatus a filter unit is provided in the first chamber. To facilitate assembly and installation, the anchor ring is a C-shaped ring. The base and housing are separated elements. The base and housing have respectively a first coupling portion and a second coupling portion corresponding to each other.

The first track portion also has a plurality of first directing members corresponding to each other. Each first directing member has a first diagonal surface. There is a first gap between the first directing members. The second track portion has a plurality of second directing members corresponding to each other. Each second directing member has a second diagonal surface. There is a second gap between the second directing members. The first anchor zone is located in the second gap. The second anchor zone is located on the second diagonal surface. To prevent the control valve stem from turning during manual operation, the control valve stem and the base have respectively at least a retaining member and a retaining track corresponding to each other to allow the retaining member to slide thereon.

In addition, the invention may be installed on a water supply such as a water pipe, faucet or the like. The housing further has a cap coupled on an outer side to be fastened to the water supply.

The water valve apparatus of the invention provides features as follows:

1. Simpler structure, and can be fabricated and assembled easily to reduce production cost.

2. The water stopper can closely seal the first opening through water pressure, thus there is no need to add an extra spring to enhance the sealing between the water stopper and the first opening.

3. As the anchor ring is movably coupled on the control valve stem, and the control valve stem and the base have respectively the retaining member and retaining track corresponding to each other, the control valve stem can be moved in the direction of the retaining track to reduce wearing of related elements to increase the life span of the apparatus.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENT

Figure 1:
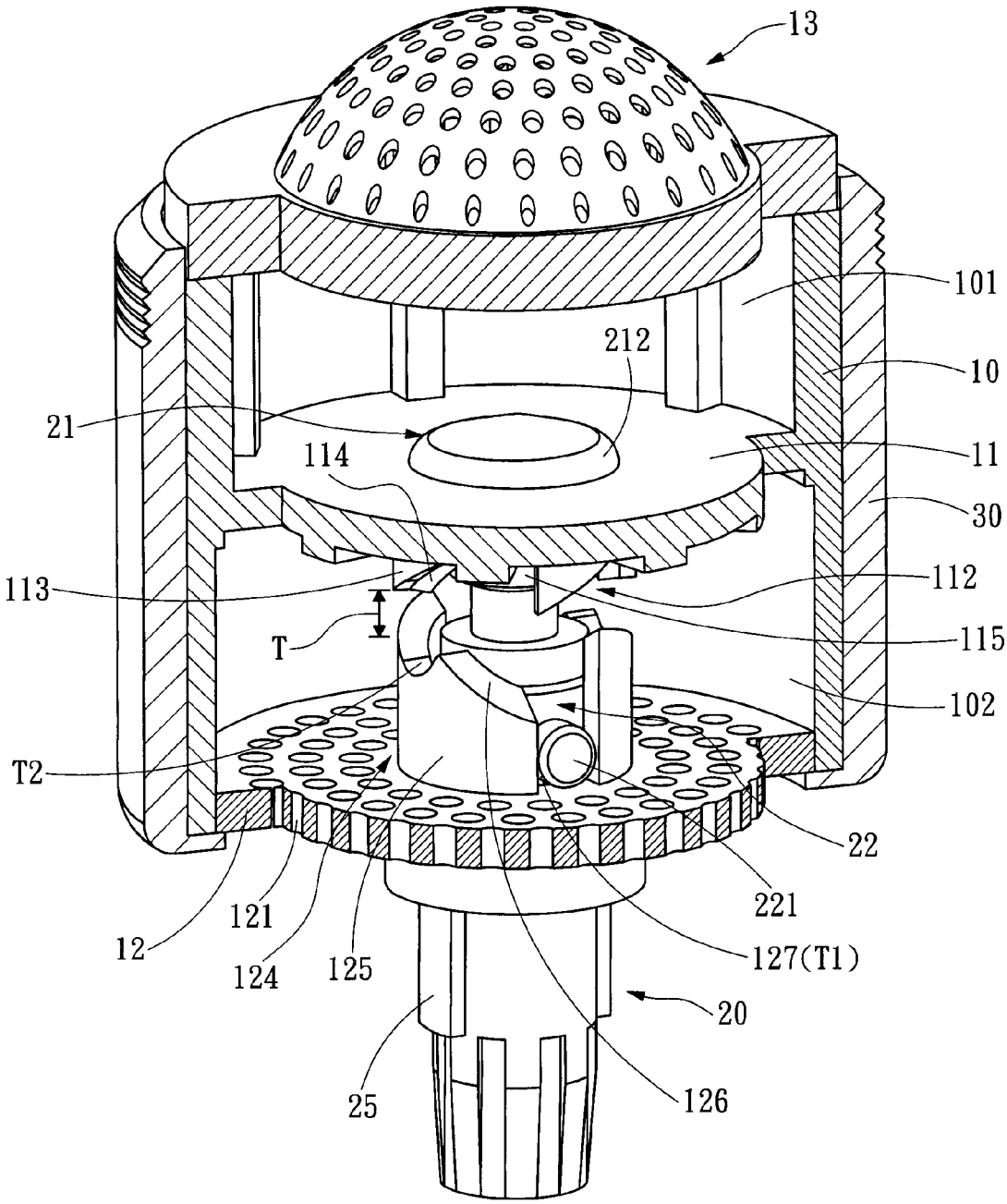
FIG. 1 is a schematic view of an embodiment of the water valve apparatus of the invention.
Figure 2A:
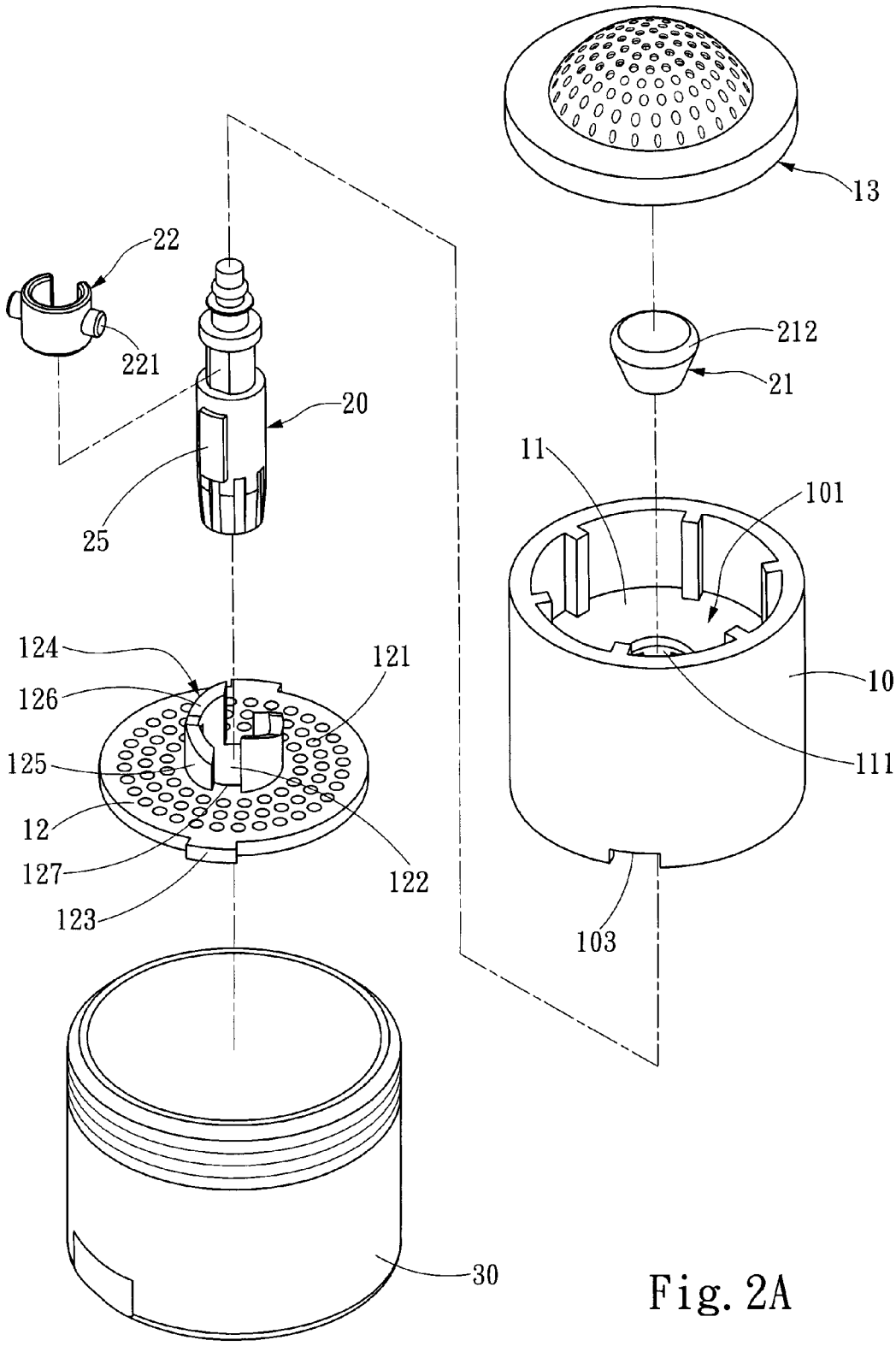
FIGS. 2A and 2B are exploded views of an embodiment of the water valve apparatus of the invention.
Figure 2B:
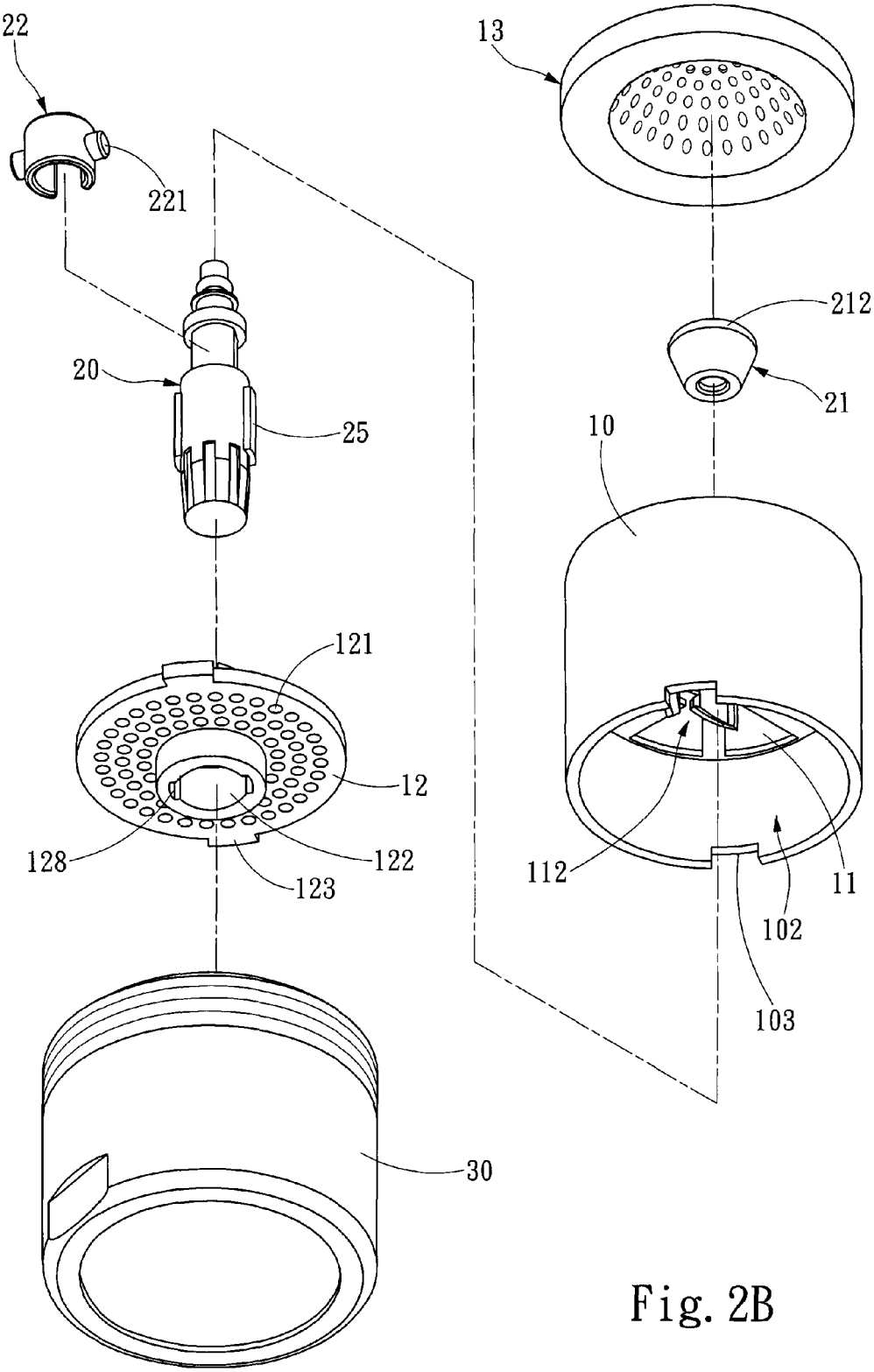
Figure 3:
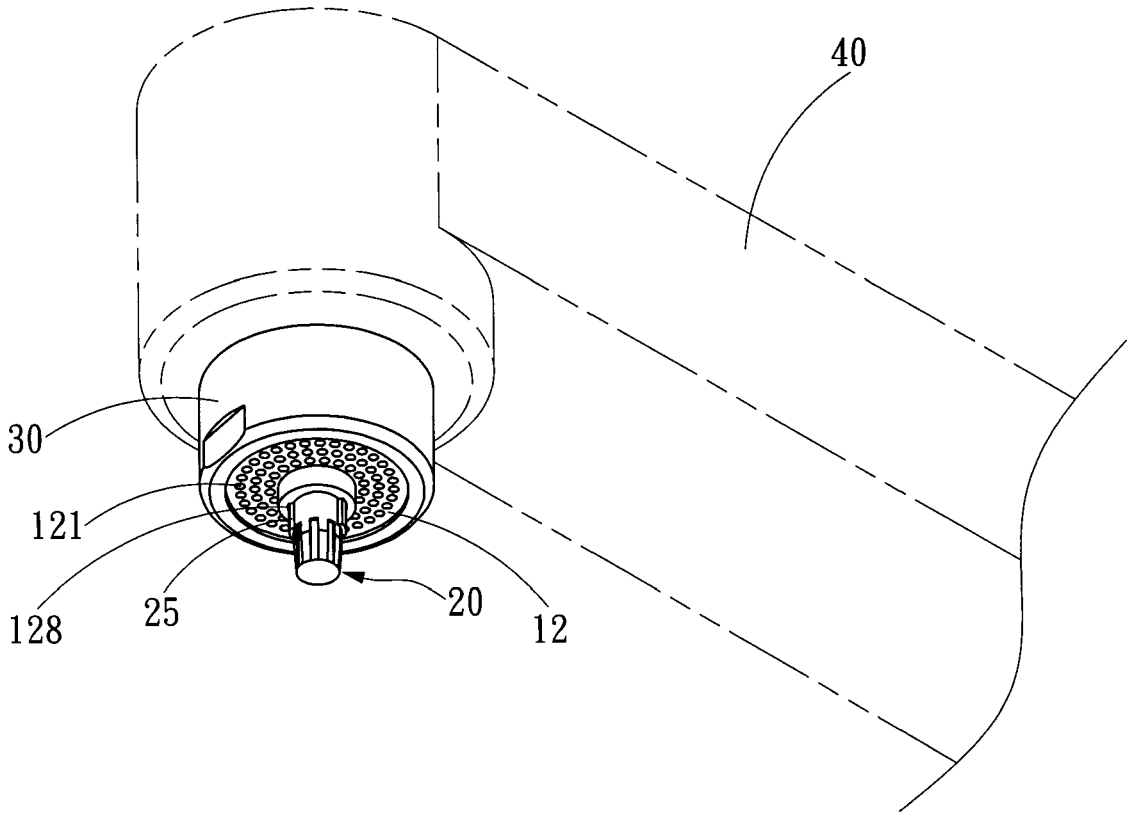
FIG. 3 is a schematic view of the water valve apparatus of the invention installed on a water faucet in a use condition.

Please refer to FIGS. 1 through 3 for a preferred embodiment of water valve apparatus of the invention adopted for use on a faucet. It includes a housing 10 and a control valve stem 20. The housing 10 has a spacer 11 to divide the interior space into a first chamber 101 and a second chamber 102, and a base 12 located at the bottom of the housing 10 with a plurality of water outlets 121 formed thereon. The spacer 11 has a first opening 111 communicating with the first chamber 101 and the second chamber 102. The base 12 has a second opening 122 corresponding to the first opening 111. The base 12 and the housing 10 are separated elements, and have respectively a first coupling portion 123 and a second coupling portion 103 corresponding to each other to allow the base 12 to be fastened on the bottom of the housing 10. In this embodiment the housing 10 is further coupled with a cap 30 on an outer side to anchor on a water supply 40 such as a water pipe or water faucet. To provide filter function, a filter unit 13 is provided in the first chamber 101 of the housing 10.

The control valve stem 20 runs through the first opening 111 and second opening 122, and has a water stopper 21 held in the first opening 111 to stop communication of the first chamber 101 and second chamber 102, and an anchor ring 22 movably coupled on the control valve stem 20. To facilitate assembly the anchor ring 22 is a C-shaped ring. In this embodiment the water stopper 21 has a top end fastened to a bulged portion 212 to withstand water pressure from water flow in the first chamber 101, and seal the first opening 111.

In order to allow the control valve stem 20 to control start and stop of water flow, the spacer 11 and the base 12 have respectively a first track portion 112 and a second track portion 124 opposing to each other. There is a displacement track T between the first track portion 112 and the second track portion 124. The anchor ring 22 has at least one anchor stub 221 in the displacement track T. In this embodiment the first track portion 112 includes a plurality of first directing members 113 corresponding to each other. Each first directing member 113 has a first diagonal surface 114. There is a first gap 115 between the first directing members 113. The second track portion 124 has a plurality of second directing members 125 corresponding to each other. Each second directing member 125 has a second diagonal surface 126. There is a second gap 127 between the second directing members 125. The displacement track T has at least one anchor zone T1 and one second anchor zone T2. The first anchor zone T1 is located in the second gap 127. The second anchor zone T2 is located on the second diagonal surface 126. To keep the control valve stem 20 moving in the direction of water pressure and manual operation the control valve stem 20 and the base 12 have respectively at least a retaining member 25 and a retaining track 128 corresponding to each other to allow the retaining member 25 to slide thereon.

Figure 4A:
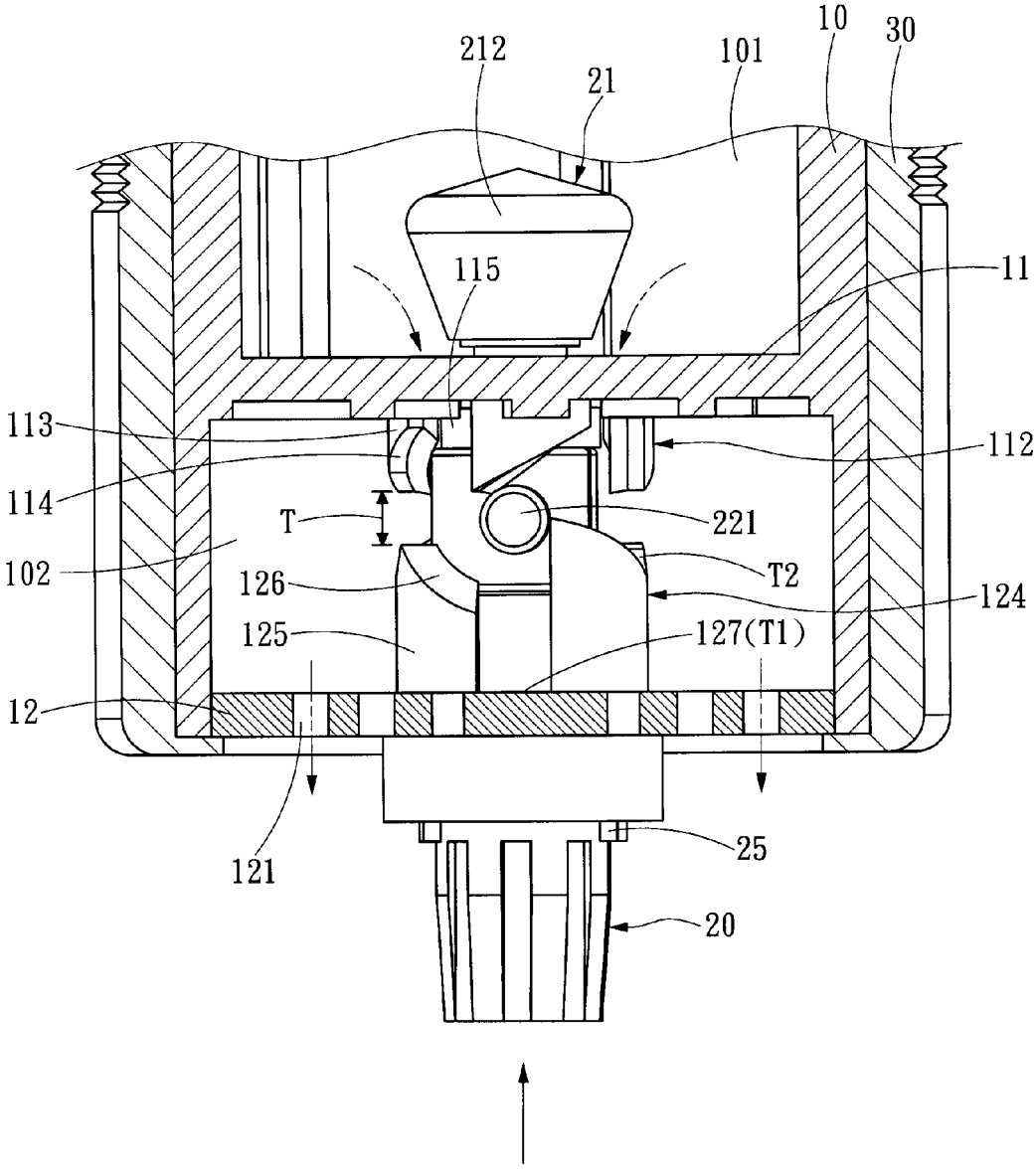
FIGS. 4A through 4F are schematic views of an embodiment of the water valve apparatus of the invention in operating conditions.
Figure 4B:
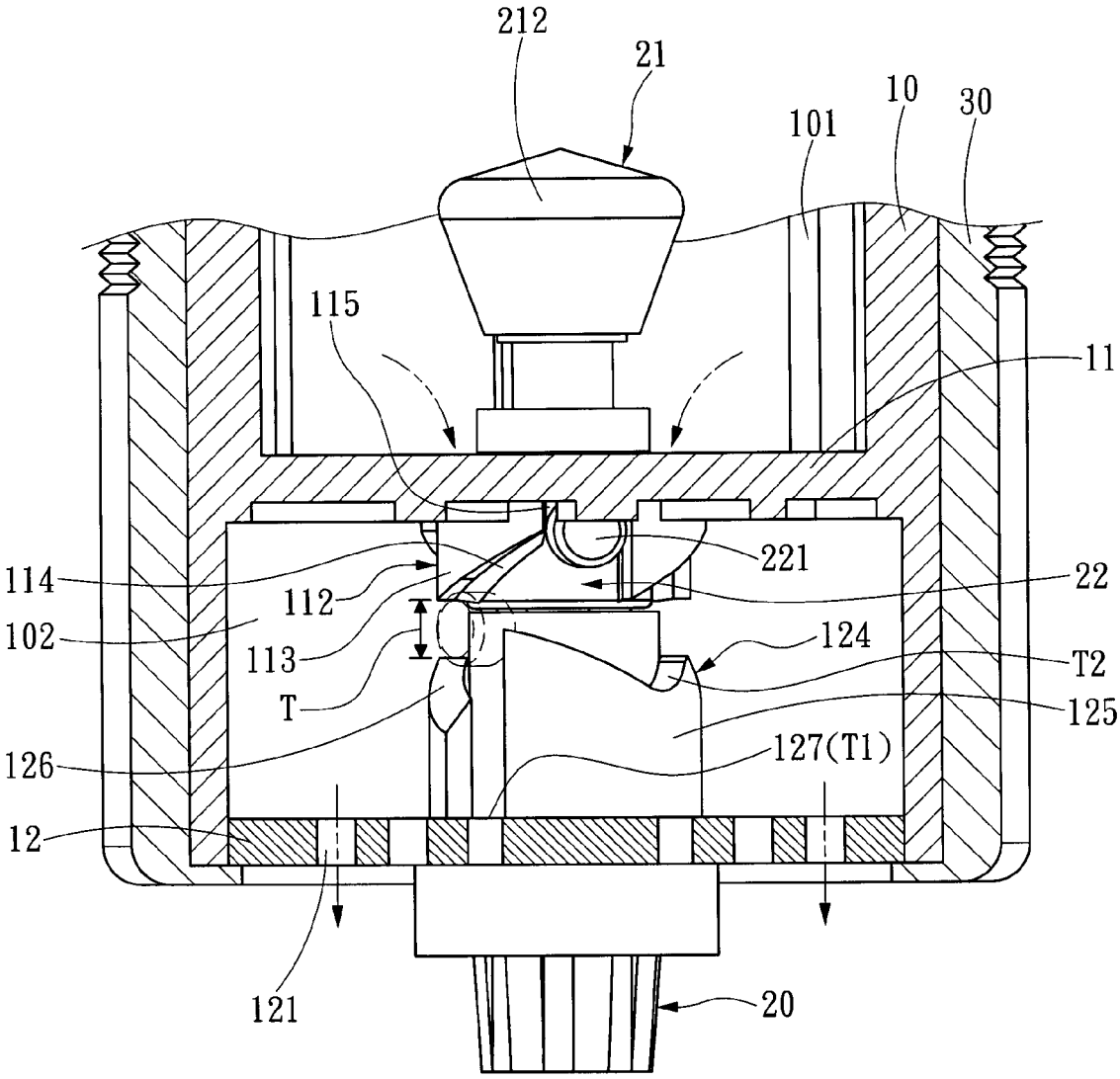
Figure 4C:
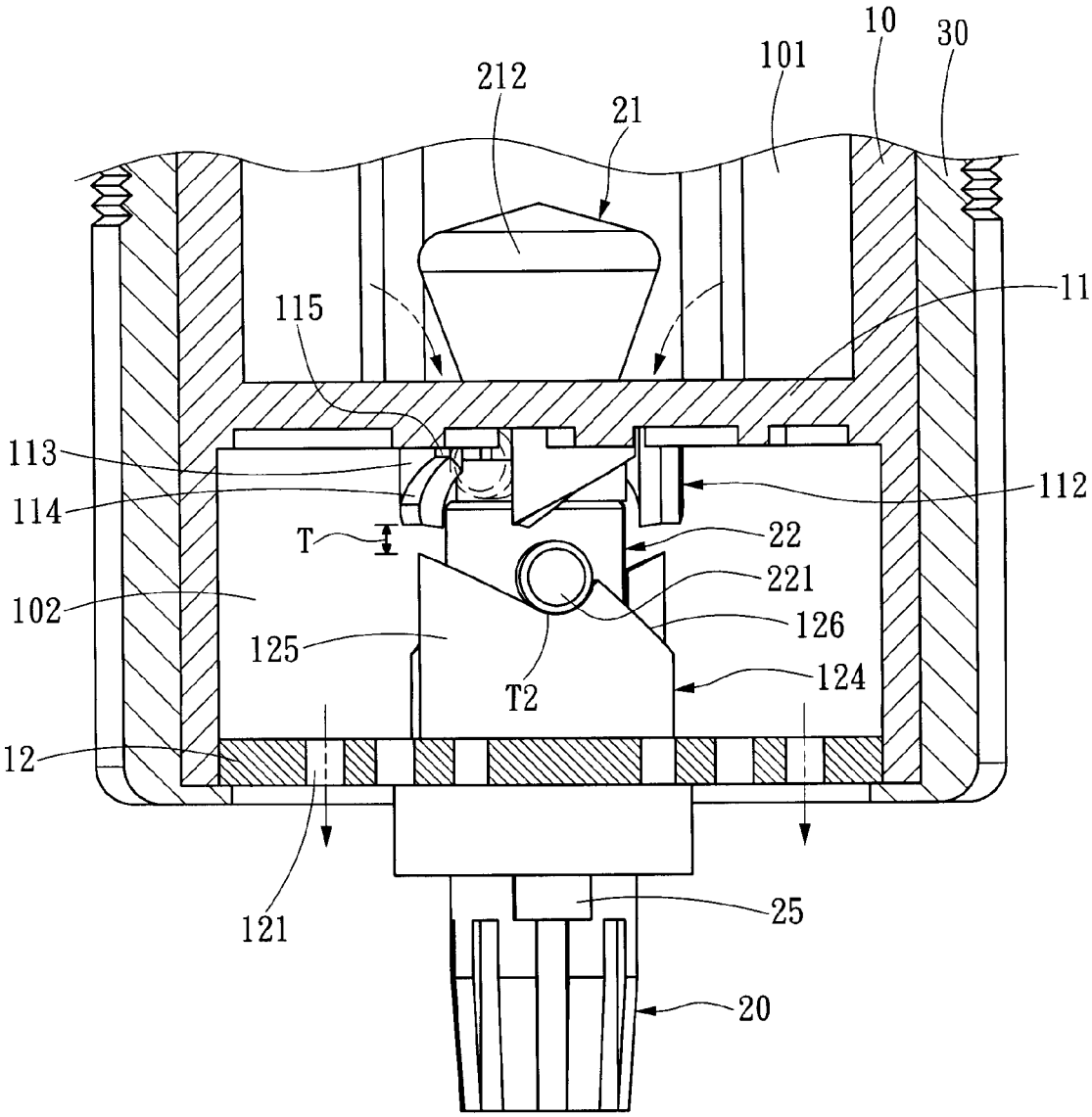

Referring to FIGS. 1 and 4A through 4F, the control valve stem 20 has a water stop position and a water supply position. At the water stop position, referring to FIG. 1, the anchor stub 221 of the anchor ring 22 is located on the first anchor zone T1 in the second gap 127 of the second track portion 124. Meanwhile the water stopper 21 of the control valve stem 20 presses the spacer 11 due to water pressure from the first chamber 101 to seal the first opening 111 so that water cannot flow from the first chamber 101 to the second chamber 102. When the control valve stem 20 is pushed by a user, the anchor ring 22 is moved upwards and the anchor stub 221 is moved away from the first anchor zone T1 in the second gap 127 to be in contact with the first directing member 113 of the first track portion 112 as shown in FIG. 4A. The anchor stub 221 in contact with the first directing member 113 moves along the first diagonal surface 114 to arrive the first gap 115 as shown in FIG. 4B. The control valve stem 20 loses the lifting force of the user and receives the water pressure from the first chamber 101, thus moves downwards so that the anchor stub 221 drops onto the second diagonal surface 126 to arrive the second anchor zone T2 as shown in FIG. 4C at the water supply position. As the second anchor zone T2 is located at an elevation higher than the first anchor zone T1, the water stopper 21 is not in contact with the spacer 11, hence water in the first chamber 101 flows through the first opening 111 to the second chamber 102 and passes through the water outlets 121 of the base 12 to be used by the user.

Figure 4D:
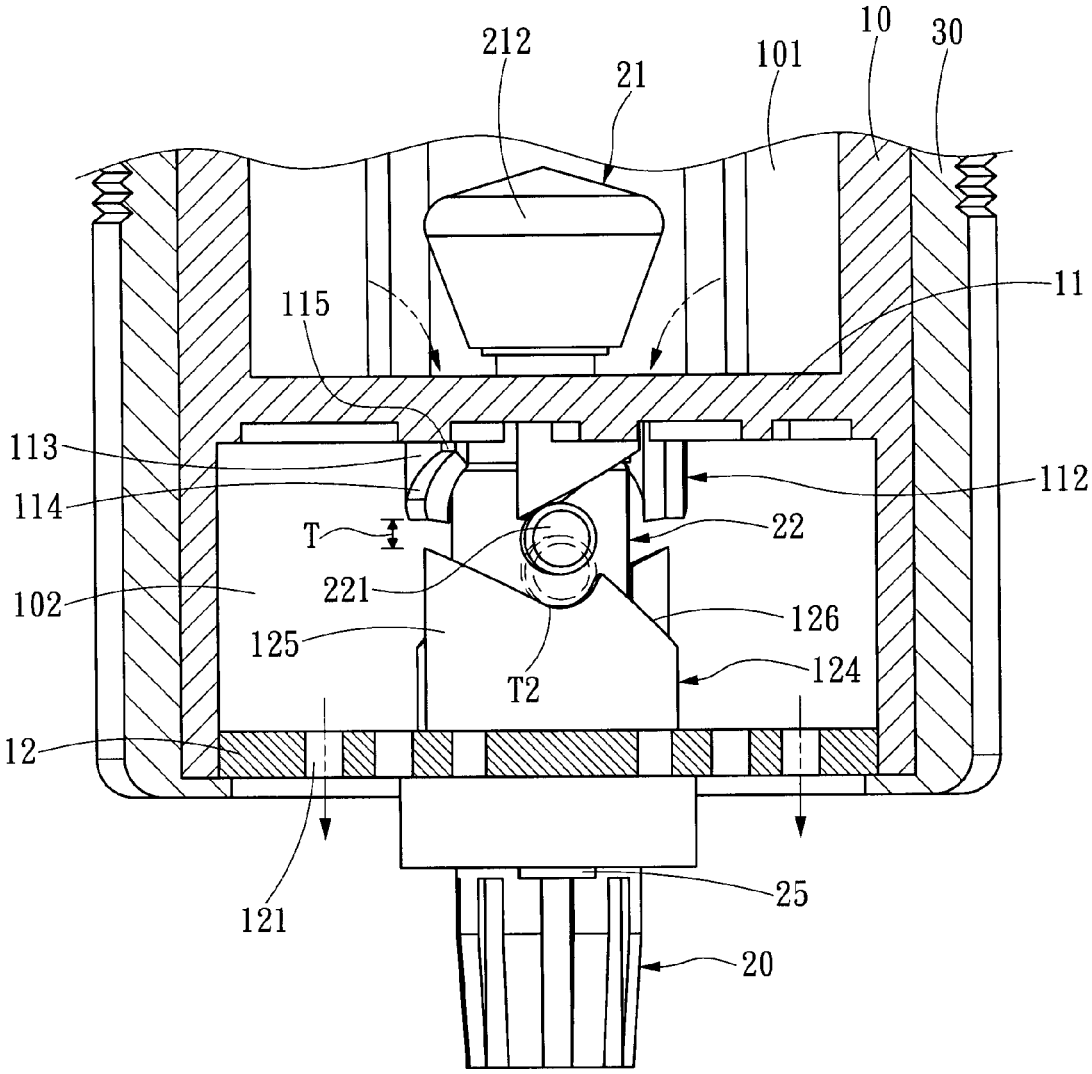
Figure 4E:
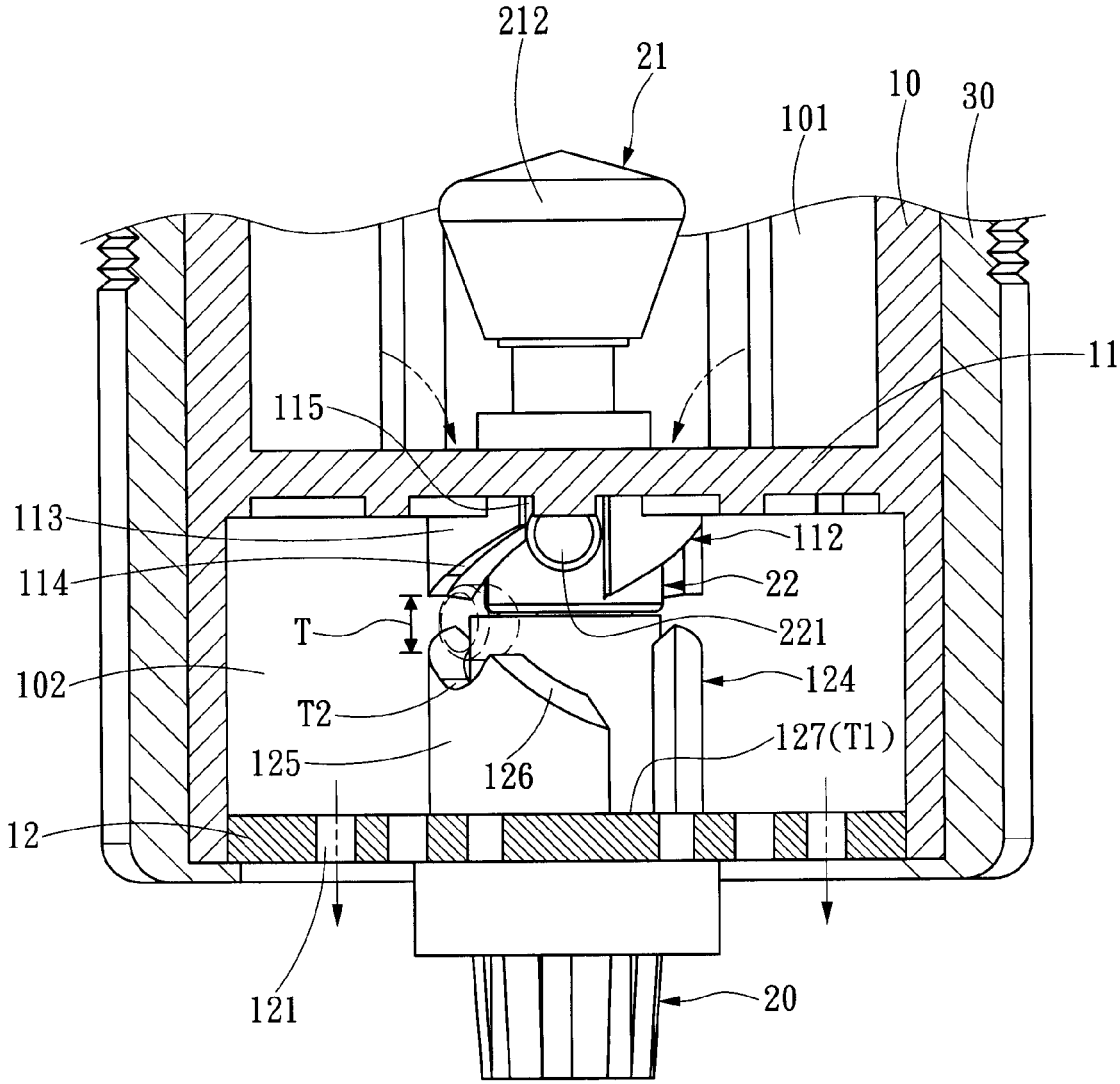
Figure 4F:
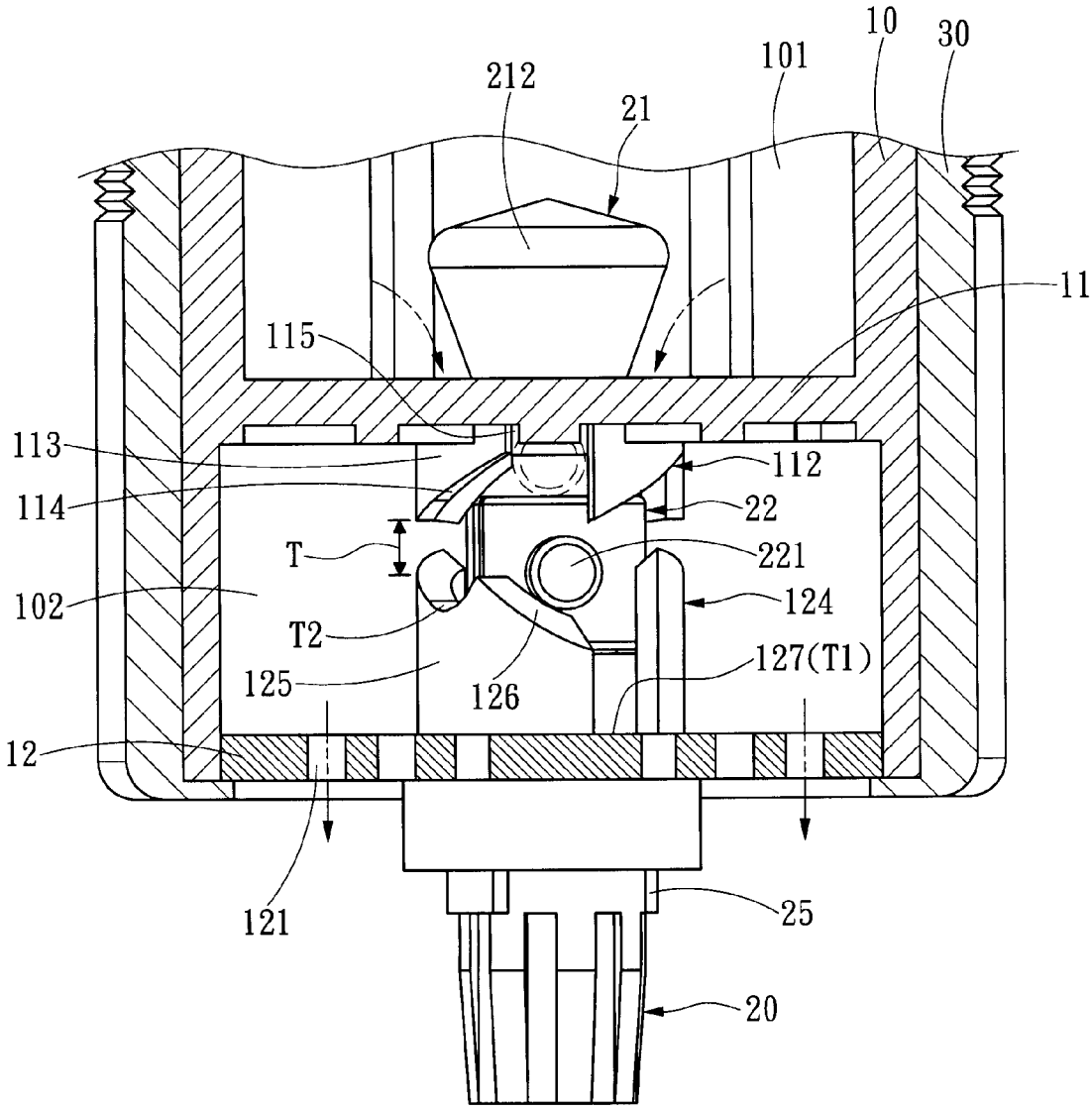

When the user finishes water usage, he/she can push the control valve stem 20 upwards again to make the anchor stub 221 in contact with the first directing member 113 as shown in FIG. 4D. The control valve stem 20 moves along the first diagonal surface 114 of the first directing member 113 to reach the first gap 115 as shown in FIG. 4E. Meanwhile, the control valve stem 20 which lost the lifting force before receives the water pressure of the first chamber 101 again and moves downwards so that the anchor stub 221 is moved to the second directing member 125 as shown in FIG. 4F, and moves along the second diagonal surface 126 to reach the first anchor zone T1 in the second gap 127 as shown in FIG. 1. Thus the water stopper 21 of the control valve stem seals the first opening 111 again to stop water from flowing into the second chamber 102 at the water stop position. In the motions set forth above, only the anchor ring 22 is turned to allow the anchor stub 221 to slide in the displacement track T. The control valve stem 20 is moved up and down without turning due to the retaining member 25 sliding in the retaining track 128.

By means of the construction previously discussed, the control valve stem can be moved, due to the anchor stub being moved to the first anchor zone or second anchor zone, to the water supply position with the first chamber communicating with the second chamber, or the water stop position with the first chamber not communicating with the second chamber. Its structure is simpler than the conventional techniques, fabrication and assembly are easier, and production cost also is lower. Moreover, the invention does not need additional springs. Through water pressure the water stopper of the control valve stem can seal the first opening to prevent water from flowing from the first chamber to the second chamber. As the anchor ring is movably coupled on the control valve stem, and the control valve stem and the base have respectively the retaining member and retaining track corresponding to each other to confine movement of the control valve stem in the direction of the retaining track without turning, wearing of elements can be reduced to enhance the life span of the apparatus.

While the preferred embodiment of the invention has been set forth for the purpose of disclosure, modifications of the disclosed embodiment of the invention as well as other embodiments thereof may occur to those skilled in the art. Accordingly, the appended claims are intended to cover all embodiments which do not depart from the spirit and scope of the invention.

What is claimed is:

1. A water valve apparatus, comprising a housing and a control valve stem, the housing having a spacer to divide the interior space thereof into a first chamber and a second chamber and a base located at the bottom thereof that has a plurality of water outlets formed thereon, the spacer having a first opening communicating with the first chamber and the second chamber, the base having a second opening corresponding to the first opening, the control valve stem running through the first opening and the second opening, wherein:

the spacer and the base have respectively a first track portion and a second track portion interposed by a displacement track which has at least a first anchor zone and a second anchor zone, the valve control stem having a water stopper located in the first opening to stop communication between the first chamber and the second chamber and an anchor ring movably coupled thereon that has at least one anchor stub in the displacement track, the anchor ring being movable through the anchor stub to the first anchor zone or the second anchor zone to drive the valve control stem to a water supply position in which the first chamber communicates with the second chamber or a water stop position in which the first chamber does not communicate with the second chamber.

2. The water valve apparatus of claim 1, wherein the housing has a cap coupled on an outer side thereof.

3. The water valve apparatus of claim 1, wherein the first chamber contains a filter unit.

4. The water valve apparatus of claim 1, wherein the water stopper has a bulged portion.

5. The water valve apparatus of claim 1, wherein the first track portion has a plurality of first directing members corresponding to each other, each of the first directing members having a first diagonal surface, the first directing members having a first gap formed between them.

6. The water valve apparatus of claim 1, wherein the second track portion has a plurality of second directing members corresponding to each other, each of the second directing members having a second diagonal surface, the second directing members having a second gap formed between them.

7. The water valve apparatus of claim 6, wherein the first anchor zone is located in the second gap.

8. The water valve apparatus of claim 6, wherein the second anchor zone is located on the second diagonal surface.

9. The water valve apparatus of claim 1, wherein the anchor ring is a C-shaped ring.

10. The water valve apparatus of claim 1, wherein the valve control stem and the base have respectively at least one retaining member and one retaining track corresponding to each other which allows the retaining member to slide therein.

11. The water valve apparatus of claim 1, wherein the base and the housing have respectively a first coupling portion and a second coupling portion corresponding to each other.

* * * * *